US006964555B2

(12) United States Patent
Ochiai et al.

(10) Patent No.: US 6,964,555 B2
(45) Date of Patent: Nov. 15, 2005

(54) CENTRIFUGAL BLOWER

(75) Inventors: Toshinori Ochiai, Obu (JP); Manabu Miyata, Obu (JP)

(73) Assignee: Denso Corporation, Kariya (JP)

( * ) Notice: Subject to any disclaimer, the term of this patent is extended or adjusted under 35 U.S.C. 154(b) by 25 days.

(21) Appl. No.: 10/742,677

(22) Filed: Dec. 19, 2003

(65) Prior Publication Data

US 2004/0131465 A1 Jul. 8, 2004

(30) Foreign Application Priority Data

Dec. 25, 2002 (JP) ..... 2002-373933

(51) Int. Cl.[7] ..... F04D 29/42

(52) U.S. Cl. ..... 415/204; 415/206; 415/211.2; 415/228; 416/186 R; 416/189

(58) Field of Search ..... 415/204, 206, 415/211.2, 213.1, 228; 416/186 R, 189

(56) References Cited

U.S. PATENT DOCUMENTS 2,330,938 A * 10/1943 Williams ..... 415/208.3

6,575,701 B2 * 6/2003 Kamiya et al. ..... 415/206

FOREIGN PATENT DOCUMENTS

| | | |
|---|---|---|
| JP | 61-200494 | 12/1986 |
| JP | 1-193099 | 8/1989 |
| JP | 5-195995 | 8/1993 |

* cited by examiner

*Primary Examiner*—Ninh H. Nguyen
(74) *Attorney, Agent, or Firm*—Harness, Dickey & Pierce, PLC

(57) ABSTRACT

In a centrifugal blower, a centrifugal fan is housed in a scroll casing and driven by a motor. The scroll casing includes a suction scroll wall and a motor scroll wall. The scroll casing forms a scroll air passage between a first protruding portion of the suction scroll wall and a second protruding portion of the motor scroll wall. A fin is provided in the scrolled air passage as a directing member for directing a secondary flow in a direction parallel to a direction of a primary flow discharging from the centrifugal fan. The fin restricts the secondary flow from colliding with the primary flow, thereby to reduce noise due to interference of the air flows.

19 Claims, 8 Drawing Sheets

CENTRIFUGAL BLOWER

CROSS REFERENCE TO RELATED APPLICATION

This application is based on Japanese Patent Application No. 2002-373933 filed on Dec. 25, 2002, the disclosure of which is incorporated herein by reference.

FIELD OF THE INVENTION

The present invention relates to a centrifugal blower for a vehicle air conditioner.

BACKGROUND OF THE INVENTION

With regard to a centrifugal blower, a centrifugal fan is generally housed in a scroll casing. The scroll casing includes a suction scroll wall, a motor scroll wall that is parallel with the suction scroll wall, and a peripheral wall connecting the peripheries of the suction scroll wall and the motor scroll wall. The suction side wall defines a suction port in a central position and forms a bell mouth on the periphery of the suction port. A motor is fixed to the central portion of the motor scroll wall. Also, the scroll casing forms a scroll passage between the periphery of the centrifugal fan and the peripheral wall. A radial dimension of the scroll passage increases toward an air downstream position. The scroll casing forms a blowing outlet at the downstream position of the scroll passage. The blowing port connects to a blowing duct. Further, the blowing duct connects to an air conditioner duct of an air conditioner unit.

With regard to a centrifugal blower disclosed in JP-A-5-195995, as shown in FIG. 12, a scroll passage 5 consists of a blowing passage 50 and a protruded passage portion 5B to restrict pressure loss and to reduce noise problem. Specifically, a scroll wall is protruded in an axial direction at a position corresponding to the scroll passage 50 so that the protruded passage portion 5B is formed.

Further, as shown in FIG. 13, the protruded passage portion 5B is proposed to have a substantially rectangular-shaped cross-section to facilitate creation of a secondary flow D2 in the scroll passage 5. In this case, the pressure loss and the noise are reduced within a wide air blowing region where the flow rate of the centrifugal blower 1 changes. However, within the scroll passage 5, the discharging flow D1 from the centrifugal fan 4 and the secondary flow D2 are likely to interfere with each other at positions proximate to the discharging ports 45 of the centrifugal fan 4, which are formed on the periphery of the centrifugal fan 4. The interference of the primary flow D1 and the secondary flow D2 may result in an increase in noise.

SUMMARY OF THE INVENTION

The present invention is made in view of the foregoing matter and it is an object of the present invention to provide a centrifugal blower capable of reducing noise by restricting a primary air flow discharging from a centrifugal fan and a secondary air flow in a scroll passage from interfering with each other.

According to a centrifugal blower of the present invention, a centrifugal fan is housed in a scroll casing and driven by a motor. The centrifugal fan includes a boss portion, a plurality of blades arranged on the periphery of the boss portion in parallel with an axial direction, and a shroud connecting the ends of the blades. The shroud defines a fan inlet port through which air is sucked in the centrifugal fan and the blades defines discharging ports through which air is discharged in a radially outward direction. The motor is connected to the boss portion. The scroll casing includes a first scroll wall defining a casing suction port, a second scroll wall opposed to the first scroll wall, and a peripheral wall connecting the first scroll wall and the second scroll wall. The centrifugal fan is disposed in the scroll casing such that the fan inlet port is adjacent to the casing suction port. The motor is fixed to the second scroll wall. The scroll casing defines a blowing passage space between the discharging ports of the centrifugal fan and the peripheral wall and into which air discharged from the centrifugal fan flows. At least one of the first scroll wall and the second scroll wall protrudes in the axial direction at a position corresponding to the blowing passage space. The blowing passage space and the a space provided in the protruded portion defines a scroll air passage. The centrifugal blower further includes a directing member disposed at a position that a primary flow discharging from the discharging ports of the centrifugal fan merges with a secondary flow that is caused in the scroll air passage so that one of the primary flow and the secondary flow is directed to be in parallel to the other.

Accordingly, it is possible to reduce pressure loss within a large air passage space of the centrifugal blower. Further, noise is reduced. Preferably, the directing member is provided by a fin in a form of annular plate disposed in the protruded portion of the scroll air passage. Alternatively the fin can be connected to at least one of the boss portion and the shroud or connected to the periphery of the blades. Further, the fin can be inclined or curved for facilitating creation of the secondary flow. Instead of the fin, the directing member can be provided by a rim formed in the inside of the protruded portion of the scroll air passage.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EMBODIMENTS

Embodiments of the present invention will be described hereinafter with reference to the drawings.

Figure 1:
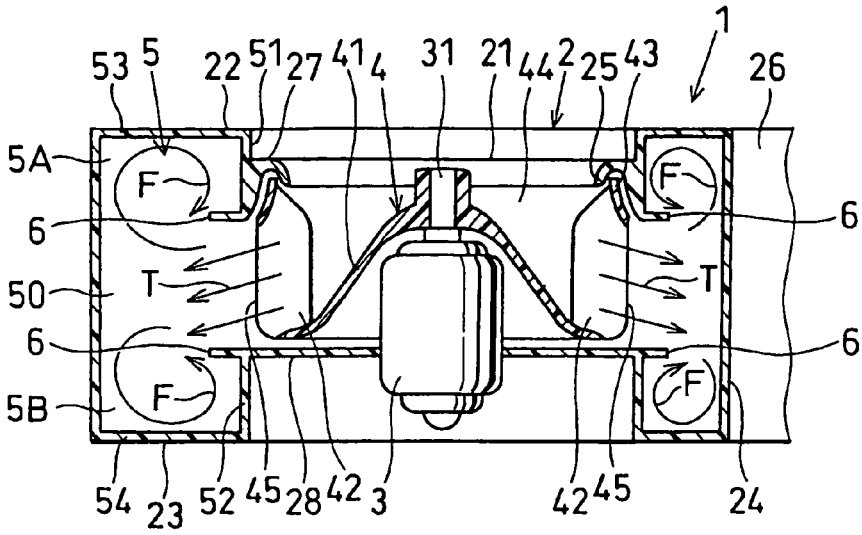
FIG. 1 is a cross-sectional view of a centrifugal blower according to the first embodiment of the present invention.
Figure 2:
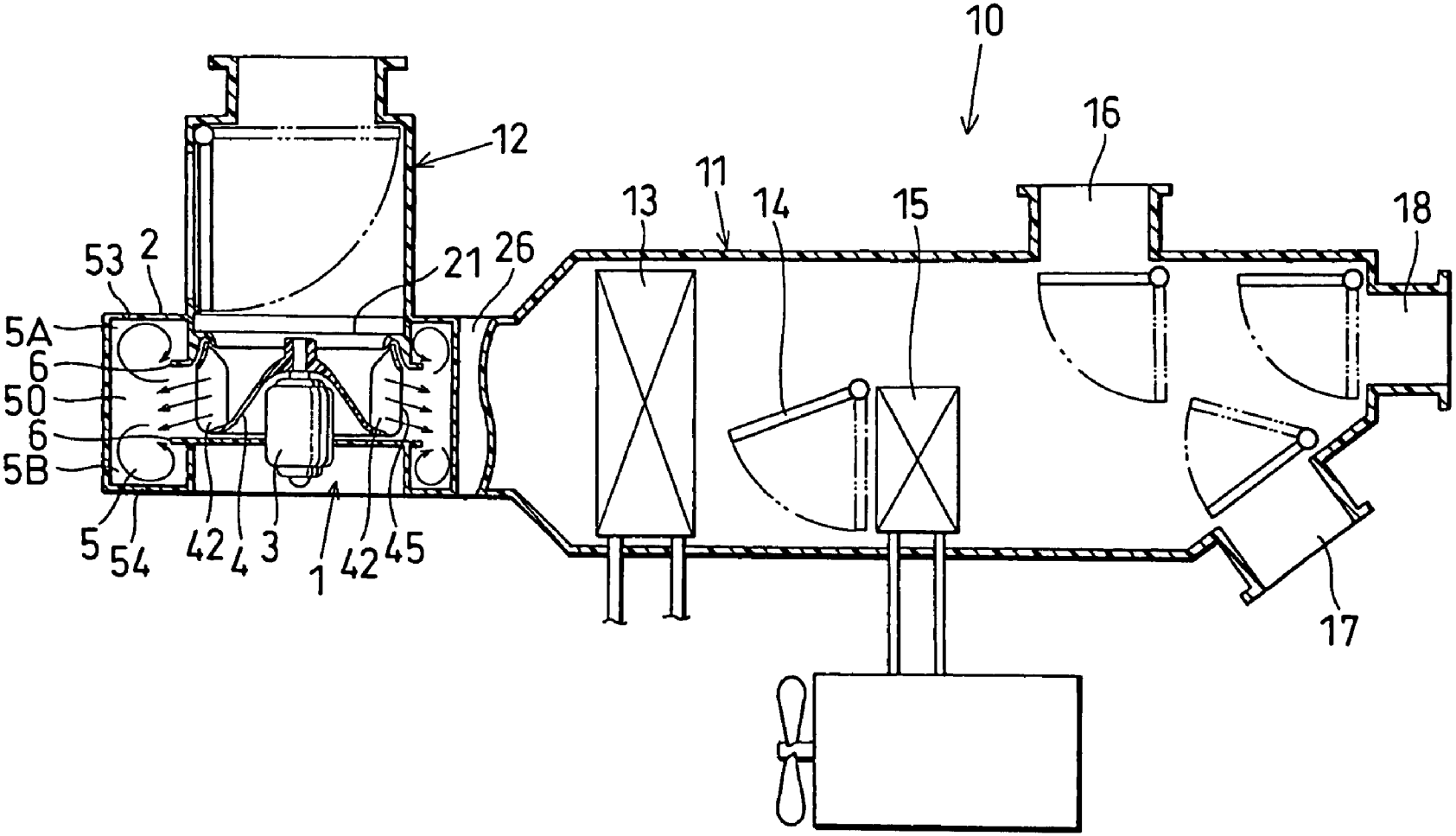
FIG. 2 is a schematic diagram of a vehicle air conditioner having the centrifugal blower according to the first embodiment of the present invention.

Referring to FIG. 1, a centrifugal blower 1 of the embodiment is used for a vehicle air conditioner 10 shown in FIG. 2. The centrifugal blower 1 has a scroll casing 2, a fan motor 3, and a centrifugal fan (sirocco fan) 4. The centrifugal fan 4 is housed in the scroll casing 2 and driven by the fan motor 3. The scroll casing 2 includes a suction scroll wall 22 (upper wall in FIG. 1), a motor scroll wall 23 (lower wall in FIG. 1), and an outer peripheral wall 24 connecting the suction scroll wall 22 and the motor scroll wall 23. The suction scroll wall 22 defines a suction port 21 through which air is sucked into the scroll casing 2, in its middle position. Also, the suction scroll wall 22 includes a bell mouth 25 on the periphery of the suction port 21. The fan motor 3 is fixed to the middle portion of the motor scroll wall 23.

As shown in FIG. 2, the centrifugal blower 1 is arranged at an upstream position of an air conditioner duct 11 of the vehicle air conditioner 10 for introducing air into the air conditioner duct 11. An inside/outside air switching box 12 is provided at a position upstream of the centrifugal blower 1. An evaporator 13, an air mix door 14, and a heater core 15 are accommodated at the middle position of the air conditioner duct 11. The evaporator 13 communicates with a vehicle refrigerant cycle system. The air mix door 14 is provided to control a temperature of air. An engine cooling water circulates in the heater core 15. Further, the air conditioner duct 11 forms a defroster opening 16, a foot opening 17 and a face opening 18 at the downstream position.

The fan 4 includes a boss portion 41, a plurality of blades 42 and a shroud 43. The boss portion 41 is connected to a rotation shaft 31 of the fan motor 3. The middle portion of the boss portion 41 protrudes toward the suction port 21 in a form of substantially dome. The blades 42 are arranged on the periphery of the boss portion 41 at predetermined intervals with respect to a rotation axis. The blades 42 are parallel with the rotation axis. The top ends of the blades 42 connect to the shroud 43. The shroud 43 has an annular shape and defines a fan suction port (inlet port) 44 on the inner periphery of the annular shape for sucking air in an axial direction. The fan 4 defines air discharging ports 45 on the outer periphery, that is between the outer peripheral ends of the blades 42 for blowing air in a radial direction.

The scroll casing 2 forms a blowing passage 50, in a form of scroll, between the outer periphery of the fan 4 defining the discharging ports 45, and the outer peripheral wall 24. A dimension of the blowing passage 50 with respect to the radial direction increases in a flow direction of air in the blowing passage 50. Also, the scroll casing 2 defines a blowing port 26 at the downstream end of the blowing passage 50. The blowing port 26 connects to the upstream end of the air conditioner duct 11. Further, the scroll casing 2 defines an upper enlarged passage space 5A and a lower enlarged passage space 5B on an upper side and lower side of the blowing passage 50, thereby to define a scroll passage 5. That is, a dimension of the scroll passage 5 is larger than the dimension of the discharging ports 45 with respect to the axial direction.

Specifically, the upper scroll wall 22 consists of a circular middle portion 27, an inner peripheral wall 51 and an upper protruding portion 53. The circular middle portion 27 has a diameter approximate to the outer diameter of the fan 4. The inner peripheral wall 51 rises from the outer peripheral end of the circular middle portion 27. The upper protruding portion 53 extends from the upper end of the inner peripheral wall 51 in the radial direction. Similarly, the lower scroll wall 23 consists of a circular middle portion 28 having a diameter approximate to the outer diameter of the fan 4, an inner peripheral wall 52 that extends from the outer peripheral end of the circular middle portion 28, and a lower protruding portion 54 that extends from the lower end of the inner peripheral wall 52 in the radial direction.

The inner peripheral wall 51, the upper protruding portion 53 and the upper portion of the outer peripheral wall 24 form a substantially rectangular shaped cross-section and define the upper enlarged passage space 5A therein. Similarly, the inner peripheral wall 52, the lower protruding portion 54, and the lower portion of the peripheral wall 24 form a substantially rectangular shaped cross-section and define the lower enlarged passage space 5B therein.

When the fan 4 rotates, air is sucked from the suction port 21 and the fan inlet port 44 and is then blown from the discharging ports 45 into the scroll passage 5. The discharging air defines a discharging flow (primary flow) T. In the scroll passage 5, the discharged air flows toward the outlet port 26 while causing a secondary flow F. Specifically, in the scroll passage 5, the air collides with the outer peripheral wall 24 and changes its flow direction upward and downward toward the upper enlarged passage space 5A and the lower enlarged passage space 5B. Further, the air turns along the upper protruding portion 53 and the lower protruding portion 54 toward the center, thereby causing the secondary flow F.

In the embodiment, the suction scroll wall 22 and the motor scroll wall 23 includes fins 6 that project into the scroll passage 5 from the respective circular middle portions 27, 28. Here, the fins 6 function as a directing member that directs the secondary flow F to be in parallel with the direction of the discharging flow T. Therefore, the fins 6 restrict the secondary flow F from colliding with the discharging flow T. As a result, noise due to interference of the discharging flow T and the secondary flow F is reduced. Further, pressure loss is restricted.

Figure 3:
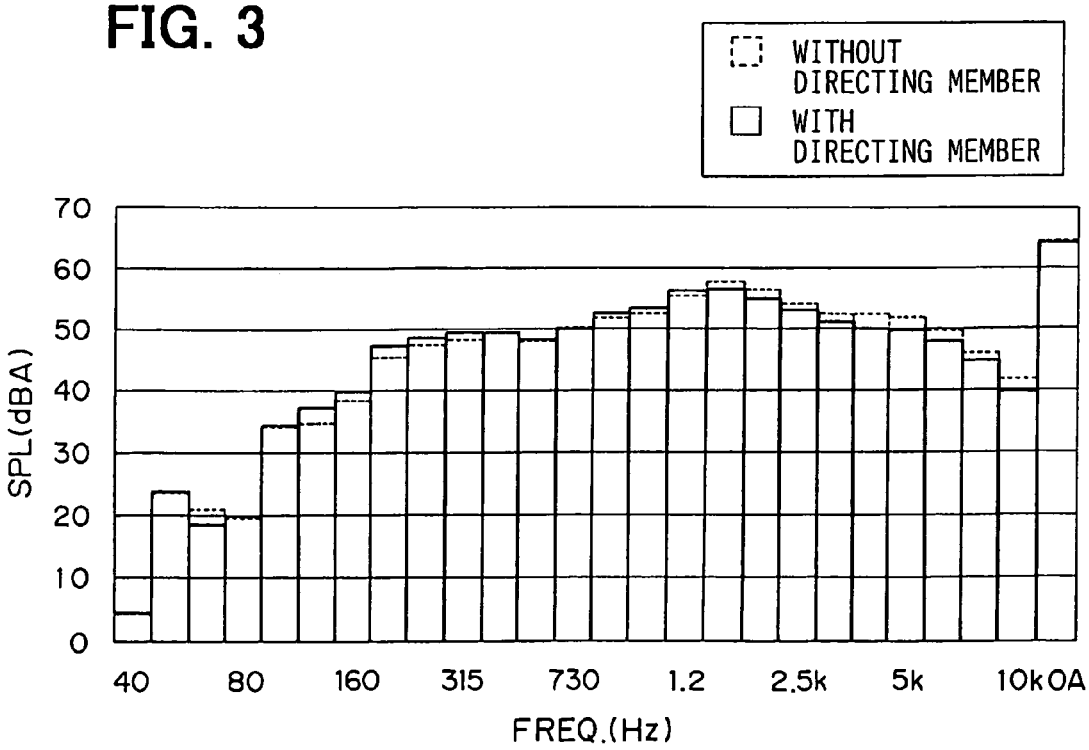
FIG. 3 is a graph for showing noise characteristic of the centrifugal blower of the first embodiment.

FIG. 3 shows noise levels (A-characteristic) of the centrifugal blower 1 of the first embodiment and a centrifugal blower as a comparison example without having the directing member. As shown in FIG. 3, within a range of 1.6 kHz to 10 kHz at which frequency is relatively high, noise level of the embodiment is lower approximately between 2.0 and 3.0 decibel than that of the comparison example. Accordingly, at least within this range, the noise level is reduced by the presence of the fins 6.

Figure 4A:
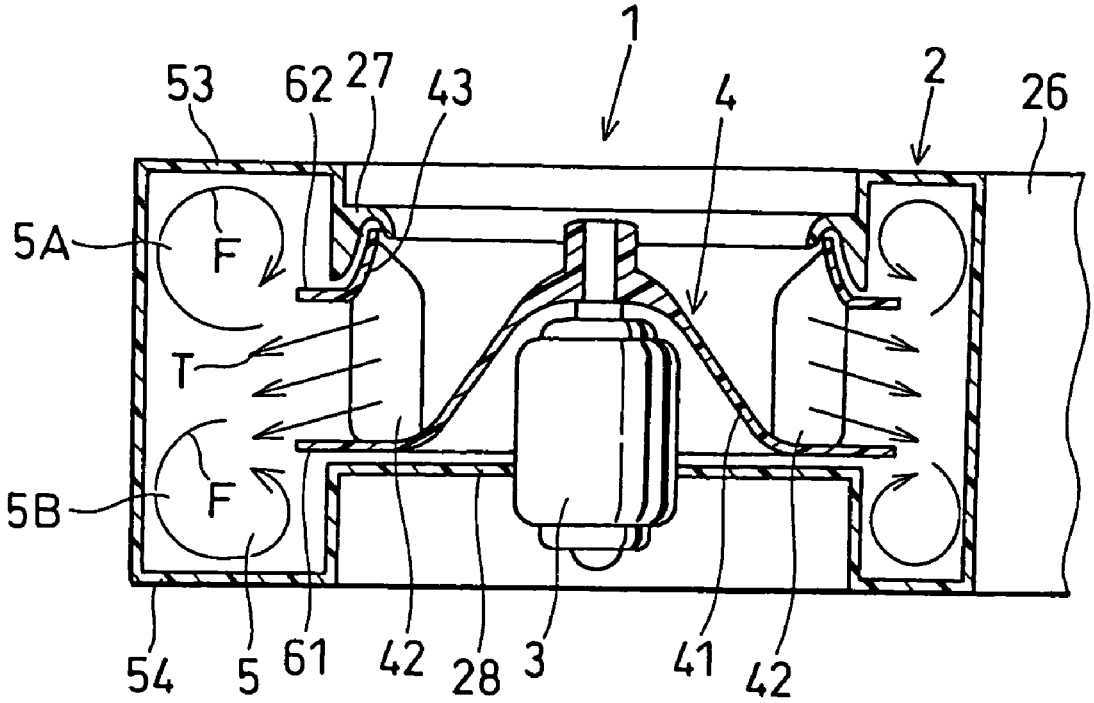
FIG. 4A is a cross-sectional view of a centrifugal blower according to the second embodiment of the present invention.

Referring to FIG. 4A, the centrifugal blower 1 of the second embodiment has a first fin 61 and a second fin 62 as the directing member. The first fin 61 extends from the periphery of the boss portion 41 into the scroll passage 5. The second fin 62 extends from the periphery of the shroud 43 into the scroll passage 5.

Figure 4B:
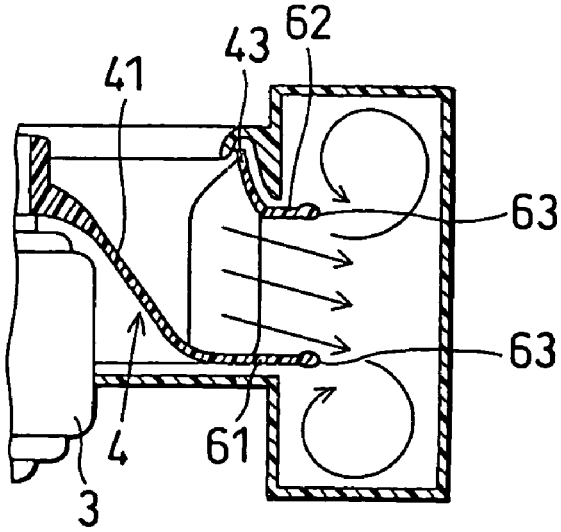
FIG. 4B is a cross-sectional view of a centrifugal blower as a modification of the second embodiment shown in FIG. 4A.

The first and second fins 61, 62 direct the secondary flow F in the direction parallel with the direction of the discharging flow T. Accordingly, the first and second fins 61, 62 provide advantageous effects similar to those of the first embodiment. As shown in FIG. 4B, thick portions 63, which are thicker than the other part of the fin 61, 62, can be formed at the ends of the first and second fins 61, 62 for increasing strength and further improving durability.

Figure 5A:
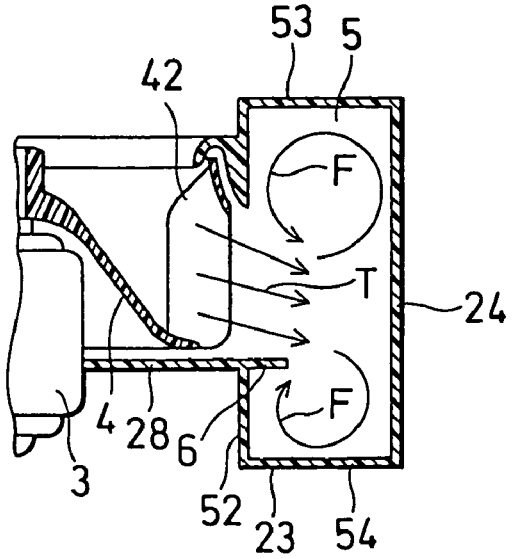
FIG. 5A is a cross-sectional view of a centrifugal blower according to the third embodiment of the present invention.

Referring to FIG. 5A, the centrifugal blower 1 of the third embodiment has a single fin 6 on the lower scroll wall 23 of the fan 4 as the directing member. Because the direction of the discharging flow T inclines downwardly, an interference degree of the secondary flow T with the discharging flow F is higher at the lower side of the fan 4 than the upper side. Therefore, the noise can be reduced sufficiently by the fin 6 provided only the lower side.

Figure 5B:
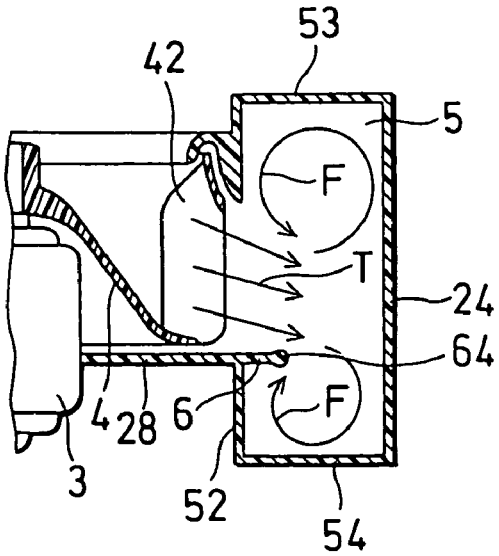
FIG. 5B is a cross-sectional view of a centrifugal blower as a modification of the third embodiment shown in FIG. 5A.

FIG. 5B shows a modification of the third embodiment. A thick portion 64, which has a substantially circular-shaped cross-section, can be provided at the end of the fin 6. Because the fin 6 do no form edges, air blowing noise is reduced. Further, the thick portion 64 increases strength of the fin 6 and therefore improves durability.

Figure 6A:
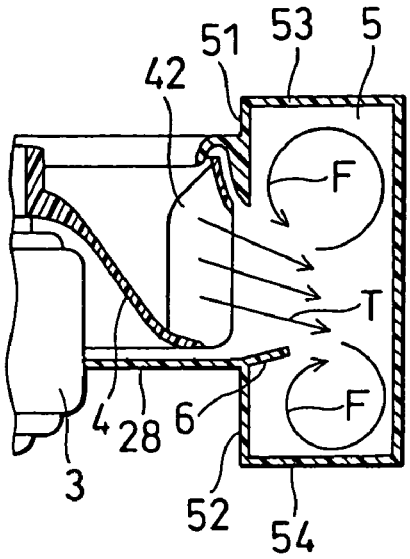
FIG. 6A is a cross-sectional view of a centrifugal blower according to the fourth embodiment of the present invention.

Referring to FIG. 6A, the centrifugal blower 1 of the fourth embodiment has the single fin 6. The fin 6 is formed to project in the scroll passage 5 and is inclined upward. This configuration facilitates creation of the secondary flow F in the lower protruding portion 54. Further, the flow velocities of the discharging flow T and the secondary flow F are uniformed. Therefore, this configuration is effective to reduce noise.

Figure 6B:
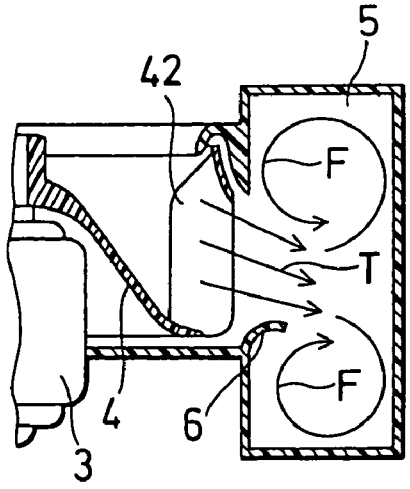
FIG. 6B is a cross-sectional view of a centrifugal blower as a modification of the fourth embodiment shown in FIG. 6A.

Alternatively, the fin 6 can be curved as shown in FIG. 6B. Accordingly, the curved fin 6 provides advantageous effect similar to that of the inclined fin 6 shown in FIG. 6A.

Figure 7A:
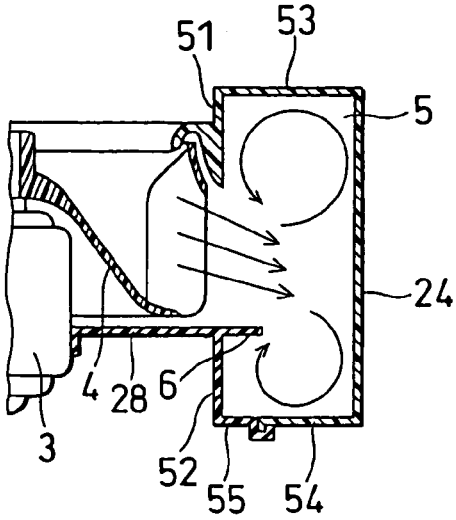
FIG. 7A is a cross-sectional view of a centrifugal blower according to the fifth embodiment of the present invention.

Referring to FIG. 7A, the centrifugal blower 1 of the fifth embodiment has the single fin 6 on the lower side of the fan 4. The fin 6 is formed such that the fin 6 extends from the circular middle portion 28 of the lower scroll wall 23 into the scroll passage 5. Here, the circular middle portion 28, the inner peripheral wall 52 and a middle wall 55 are integrally molded into a single piece. The middle wall 55 is a part of the lower protruding portion 54 and adjacent to the central position.

The fan motor 3, the fan 4 and the lower scroll wall 23 are joined as a sub-assembly. Then, the sub-assembly is joined to the upper scroll wall 22, and therefore the centrifugal blower 1 is assembled. Accordingly, assembling workability of the centrifugal blower 1 improves and therefore the maintenance of the centrifugal blower 1 is easy. Further, the moldability of the scroll casing 2 improves.

Figure 7B:
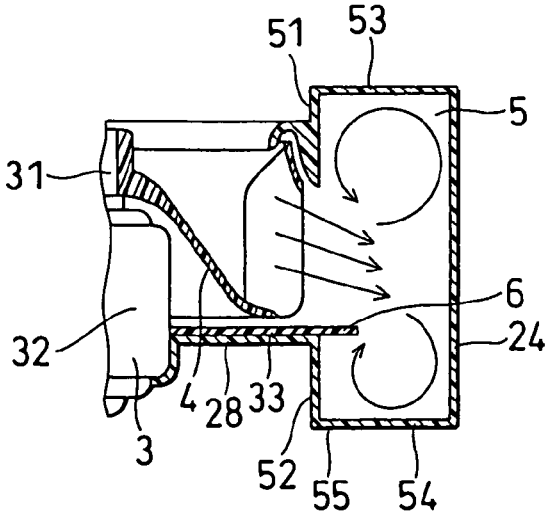
FIG. 7B is a cross-sectional view of a centrifugal blower as a modification of the fifth embodiment shown in FIG. 7A.

FIG. 7B shows a modification of the fifth embodiment. The fin 6 can be provided by a motor bracket 33 in a form of annular plate. The motor bracket 33 is fixed to the outer periphery of the casing 32 of the fan motor 3. The periphery of the motor bracket 33 radially extends into the scroll passage 5.

Figure 8A:
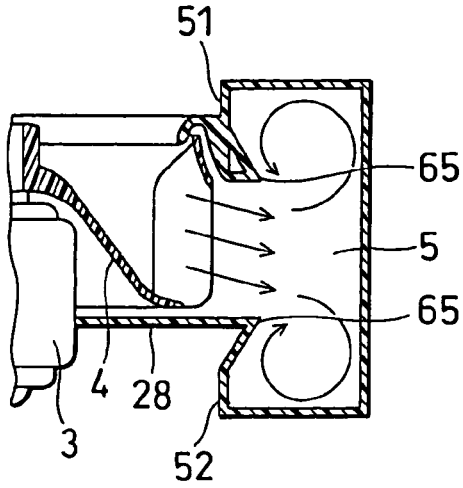
FIG. 8A is a cross-sectional view of a centrifugal blower according to the sixth embodiment of the present invention.

Referring to FIG. 8A, the centrifugal blower 1 of the sixth embodiment has fins (rims) 65 as the directing member. The inner peripheral walls 51, 52 of the upper and lower scroll walls 22, 23 sharply project into the scroll passage 5, thereby to provide the fins 65. The ends of the fins 65 form the acute angle. Accordingly, the fins 65 having the acute angle provide advantages similar to those of the fins 6.

Figure 8B:
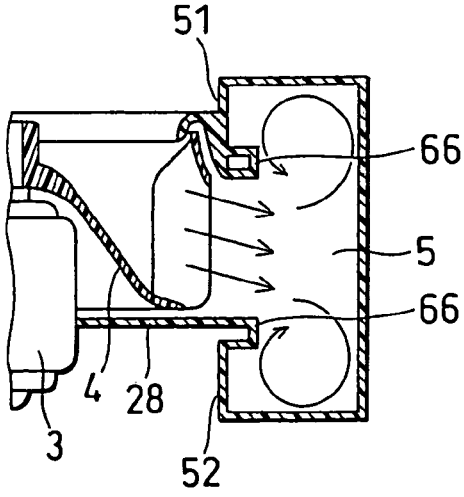
FIG. 8B is a cross-sectional view of a centrifugal blower as a modification of the sixth embodiment shown in FIG. 8A.

FIG. 8B shows a modification of the sixth embodiment. In place of the fins 65, thick fins 66 are formed to project in the scroll passage 5. The dimension of the fin 66 is increased in the axial direction.

Figure 9A:
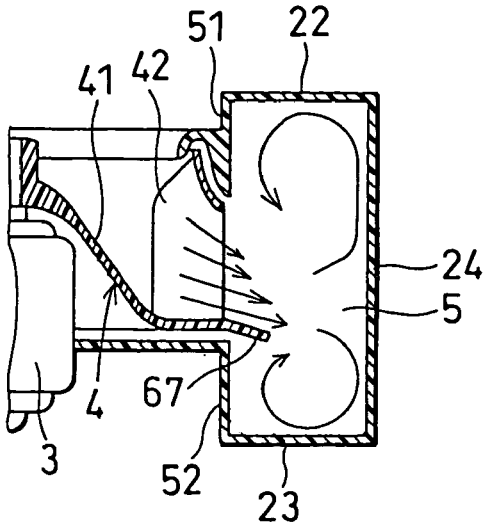
FIG. 9A is a cross-sectional view of a centrifugal blower according to the seventh embodiment of the present invention.
Figure 9B:
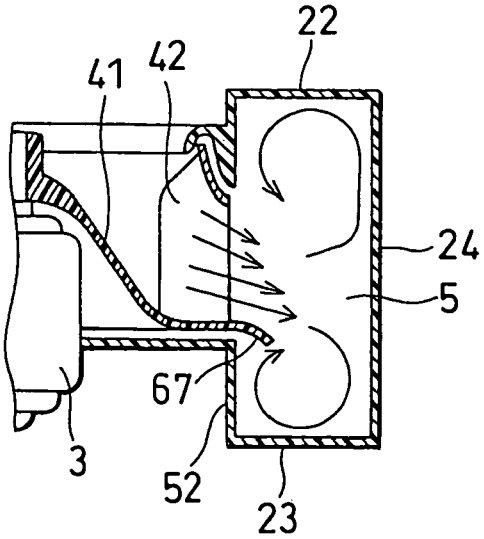
FIG. 9B is a cross-sectional view of a centrifugal blower as a modification of the seventh embodiment shown in FIG. 9A.

Referring to FIG. 9A, the centrifugal blower 1 of the seventh embodiment has a fin 67 as the directing member. The periphery of the boss potion 41 extends into the scroll passage 5 and inclines downwardly, thereby to provide the fin 67. Alternatively, as shown in FIG. 9B, the fin 67 can be curved downwardly. Accordingly, the fin 67 provides advantages as the directing member.

Figure 10A:
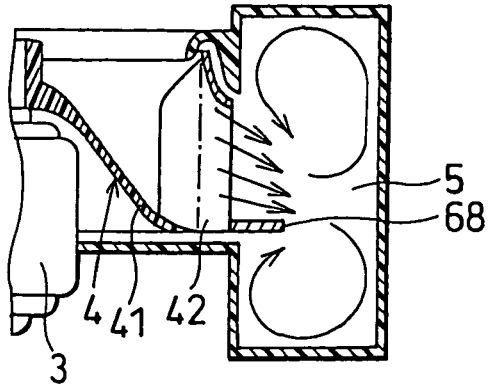
FIG. 10A is a cross-sectional view of a centrifugal blower according to the eighth embodiment of the present invention.
Figure 10B:
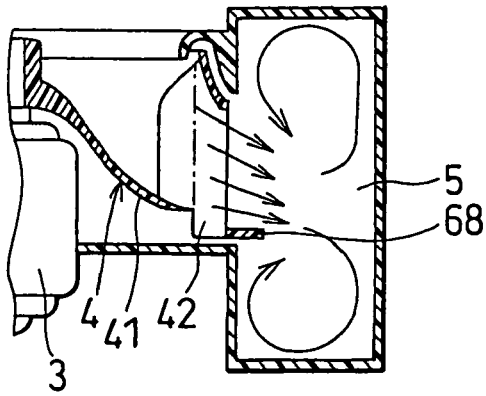
FIG. 10B is a cross-sectional view of a centrifugal blower as a modification of the eighth embodiment shown in FIG. 10A.

Referring to FIG. 10A, the centrifugal blower 1 of the eighth embodiment has a fin 68 as the directing member. The fin 68 is formed to extend from the lower ends of the blades 42. In this case, the fan 4 is easily removed from a molding die. The eighth embodiment can modified as shown in FIG. 10B. The lower ends of the blades 42 are elongated in the axial direction and the fin 68 extends from the peripheries of the elongated lower ends of the blades 42. Accordingly, this configuration restricts the discharging air T from leaking from spaces between the boss portion 41 and the blades 42.

Figure 11A:
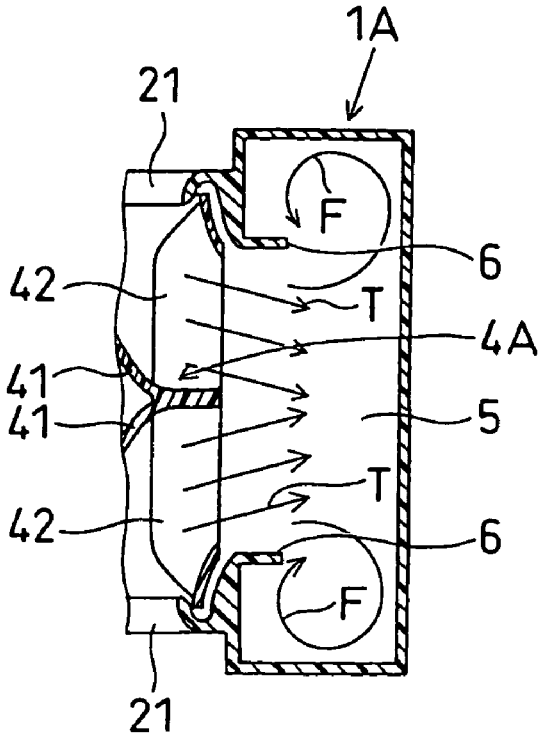
FIG. 11A is a cross-sectional view of a centrifugal blower according to the ninth embodiment of the present invention.

FIG. 11A shows a centrifugal blower 1A of the ninth embodiment. The centrifugal blower 1A is a double-suction type having suction Ports 21 on the upper side and the lower side. The fan 4 has a symmetric structure with respect a horizontal axis. The scroll casing of the centrifugal blower 1A has fins 6. Also in this case, the advantage similar to the first embodiment is provided.

Figure 11B:
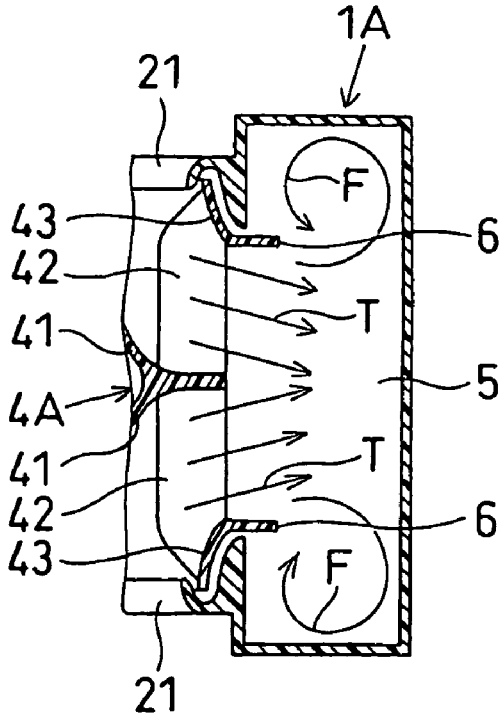
FIG. 11B is a cross-sectional view of a centrifugal blower as a modification of the ninth embodiment shown in FIG. 11A.
Figure 12:
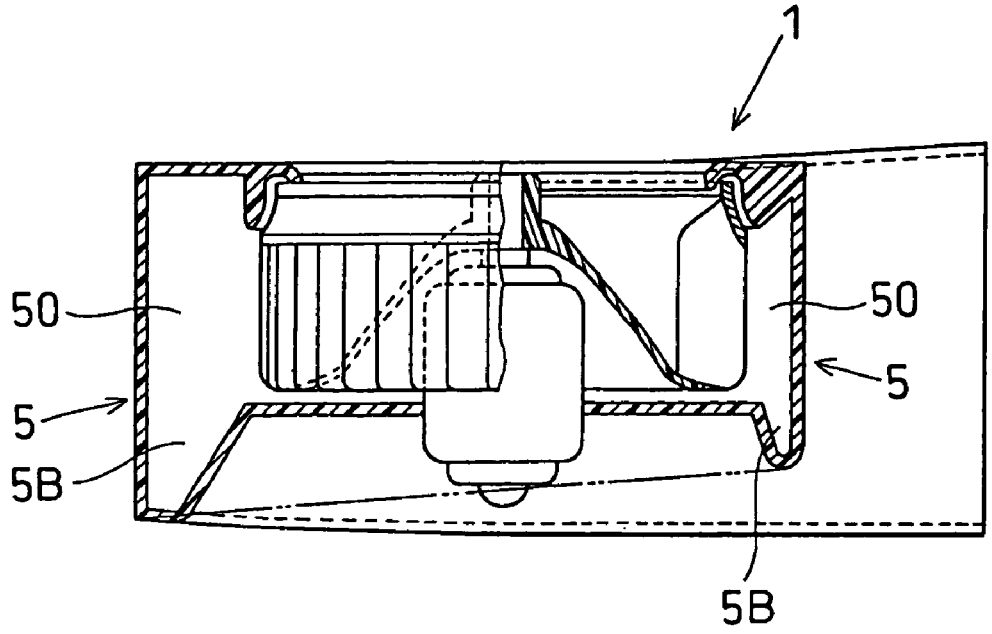
FIG. 12 PRIOR ART
FIG. 12 is a cross-sectional view of a centrifugal blower of a prior art.
Figure 13:
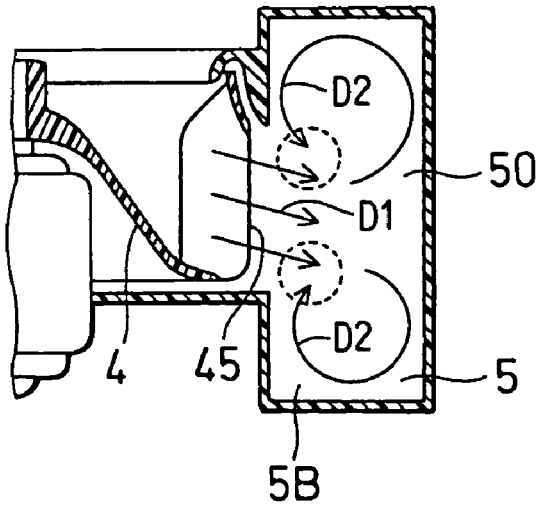
FIG. 13 RELATED ART
FIG. 13 is a cross-sectional view of a centrifugal blower of a related art.

The ninth embodiment can be modified as shown in FIG. 11B. The fin 6 is formed on the shroud 43. Also in this case, advantage similar to the first embodiment can be provided.

In addition to the above embodiments, the centrifugal blower 1 can be provided with variable combinations of the above described embodiments. For example, the fin 68 of the eighth embodiment can be inclined or curved in the manner similar to that of the seventh embodiment. Further, the fin 68 can have thick portion at its peripheral ends to increase strength.

The present invention should not be limited to the disclosed embodiment, but may be implemented in other ways without departing from the spirit of the invention.

What is claimed is:

1. A centrifugal blower comprising:

a centrifugal fan including a boss portion, a plurality of blades arranged on a periphery of the boss portion in parallel to an axial direction, and a shroud connecting to ends of the blades, wherein the shroud defines a fan inlet port through which air is sucked in the centrifugal fan and the blades define discharging ports through which air is discharged in a radially outward direction;

a motor connected to the boss portion for driving the centrifugal fan;

a scroll casing including a first scroll wall defining a casing suction port, a second scroll wall opposed to the first scroll wall and holding the motor, and a peripheral wall connecting the first scroll wall and the second scroll wall, wherein the scroll casing houses the centrifugal fan such that the fan inlet port is adjacent to the casing suction port and defines a blowing passage space between the discharging ports and the peripheral wall and into which air discharged from the centrifugal fan flows, and at least one of the first scroll wall and the second scroll wall protrudes in the axial direction at a position corresponding to the blowing passage space so that the blowing passage space and a space provided in the protruded portion define a scroll air passage; and a directing member disposed at a position that a primary flow discharging from the centrifugal fan and a secondary flow that is created in the scroll air passage merge with each other so that one of the primary air flow and the secondary air flow is directed to be in parallel with the other; wherein the directing member is provided by a fin in a form of annular plate, and the fin is disposed in an inside of the protruded portion.

2. The centrifugal blower according to claim 1, wherein the fin has a thick portion at its outer peripheral end so that a thickness of the outer peripheral end of the fin is greater than that of a remaining portion of the fin.

3. The centrifugal blower according to claim 1, wherein the fin is inclined with respect to the axial direction.

4. The centrifugal blower according to claim 1, wherein the fin includes a curved portion.

5. A centrifugal blower comprising:

a centrifugal fan including a boss portion, a plurality of blades arranged on a periphery of the boss portion in parallel to an axial direction, and a shroud connecting to ends of the blades, wherein the shroud defines a fan inlet port through which air is sucked in the centrifugal fan and the blades define discharging ports through which air is discharged in a radially outward direction;

a motor connected to the boss portion for driving the centrifugal fan;

a scroll casing including a first scroll wall defining a casing suction port, a second scroll wall opposed to the first scroll wall and holding the motor, and a peripheral wall connecting the first scroll wall and the second scroll wall, wherein the scroll casing houses the centrifugal fan such that the fan inlet port is adjacent to the casing suction port and defines a blowing passage space between the discharging ports and the peripheral wall and into which air discharged from the centrifugal fan flows, and at least one of the first scroll wall and the second scroll wall protrudes in the axial direction at a position corresponding to the blowing passage space so that the blowing passage space and a space provided in the protruded portion define a scroll air passage; and a directing member disposed at a position that a primary flow discharging from the centrifugal fan and a secondary flow that is created in the scroll air passage merge with each other so that one of the primary air flow and the secondary air flow is directed to be in parallel with the other; wherein the directing member is provided by a fin in a form of annular plate, and the fin connects to at least one of a peripheral end of the boss portion and a peripheral end of the shroud.

6. The centrifugal blower according to claim 5, wherein the fin has a thick portion at its outer peripheral end so that a thickness of the outer peripheral end of the fin is greater than that of a remaining portion of the fin.

7. The centrifugal blower according to claim 5, wherein the fin is inclined with respect to the axial direction.

8. The centrifugal blower according to claim 5, wherein the fin includes a curved portion.

9. A centrifugal blower comprising:

a centrifugal fan including a boss portion, a plurality of blades arranged on a periphery of the boss portion in parallel to an axial direction, and a shroud connecting to ends of the blades, wherein the shroud defines a fan inlet port through which air is sucked in the centrifugal fan and the blades define discharging ports through which air is discharged in a radially outward direction;

a motor connected to the boss portion for driving the centrifugal fan;

a scroll casing including a first scroll wall defining a casing suction port, a second scroll wall opposed to the first scroll wall and holding the motor, and a peripheral wall connecting the first scroll wall and the second scroll wall, wherein the scroll casing houses the centrifugal fan such that the fan inlet port is adjacent to the casing suction port and defines a blowing passage space between the discharging ports and the peripheral wall and into which air discharged from the centrifugal fan flows, and at least one of the first scroll wall and the second scroll wall protrudes in the axial direction at a position corresponding to the blowing passage space so that the blowing passage space and a space provided in the protruded portion define a scroll air passage; and a directing member disposed at a position that a primary flow discharging from the centrifugal fan and a secondary flow that is created in the scroll air passage merge with each other so that one of the primary air flow and the secondary air flow is directed to be in parallel with the other; wherein the directing member is provided by a fin in a form of annular plate, and the fin is disposed on the outer periphery of the blades.

10. The centrifugal blower according to claim 9, wherein the ends of the blades are elongated in the axial direction from the boss portion, and the fin is disposed on the peripheries of the elongated portions of the blades.

11. The centrifugal blower according to claim 9, wherein the fin has a thick portion at its outer peripheral end so that a thickness of the outer peripheral end of the fin is greater than that of a remaining portion of the fin.

12. The centrifugal blower according to claim 9, wherein the fin is inclined with respect to the axial direction.

13. The centrifugal blower according to claim 9, wherein the fin includes a curved portion.

14. A centrifugal blower comprising:

a centrifugal fan including a boss portion, a plurality of blades arranged on a periphery of the boss portion in parallel to an axial direction, and a shroud connecting to ends of the blades, wherein the shroud defines a fan inlet port through which air is sucked in the centrifugal fan and the blades define discharging ports through which air is discharged in a radially outward direction;

a motor connected to the boss portion for driving the centrifugal fan;

a scroll casing including a first scroll wall defining a casing suction port, a second scroll wall opposed to the first scroll wall and holding the motor, and a peripheral wall connecting the first scroll wall and the second scroll wall, wherein the scroll casing houses the centrifugal fan such that the fan inlet port is adjacent to the casing suction port and defines a blowing passage space between the discharging ports and the peripheral wall and into which air discharged from the centrifugal fan flows, and at least one of the first scroll wall and the second scroll wall protrudes in the axial direction at a position corresponding to the blowing passage space so that the blowing passage space and a space provided in the protruded portion define a scroll air passage; and a directing member disposed at a position that a primary flow discharging from the centrifugal fan and a secondary flow that is created in the scroll air passage merge with each other so that one of the primary air flow and the secondary air flow is directed to be in parallel with the other; wherein the directing member is provided by a rim formed in an inside of the protruded portion, and the rim forms an edge having an acute angle.

15. A centrifugal blower comprising:

a centrifugal fan including a boss portion, a plurality of blades arranged on a periphery of the boss portion in parallel to an axial direction, and a shroud connecting to ends of the blades, wherein the shroud defines a fan inlet port through which air is sucked in the centrifugal fan and the blades define discharging ports through which air is discharged in a radially outward direction;

a motor connected to the boss portion for driving the centrifugal fan;

a scroll casing including a first scroll wall defining a casing suction port, a second scroll wall opposed to the first scroll wall and holding the motor, and a peripheral wall connecting the first scroll wall and the second scroll wall, wherein the scroll casing houses the centrifugal fan such that the fan inlet port is adjacent to the casing suction port and defines a blowing passage space between the discharging ports and the peripheral wall and into which air discharged from the centrifugal fan flows to contact the peripheral wall, and at least one of the first scroll wall and the second scroll wall protrudes in the axial direction at a position corresponding to the blowing passage space to define a protruded portion so that the blowing passage space and an enlarged passage space provided in the protruded portion define a scroll air passage; and a directing member disposed at a position that a primary air flow that is created in the blowing passage space by the air discharged from the centrifugal fan and a secondary flow that is created in the enlarged passage space provided in the protruded portion combine with each other in the scroll air passage so that one of the primary air flow and the secondary air flow is directed to be in parallel with the other.

16. The centrifugal blower according to claim 1, wherein the directing member is disposed to project between the blowing passage space and the enlarged passage space defined in the protruded portion.

17. The centrifugal blower according to claim 1, wherein the directing member is integrally formed with at least one of the first scroll wall, the second scroll wall, the shroud, and the boss portion.

18. A centrifugal blower comprising:

a centrifugal fan including a boss portion, a plurality of blades arranged on a periphery of the boss portion in parallel to an axial direction, and a shroud connecting to ends of the blades, wherein the shroud defines a fan inlet port through which air is sucked in the centrifugal fan and the blades define discharging ports through which air is discharged in a radially outward direction;

a motor connected to the boss portion for driving the centrifugal fan;

a scroll casing including a first scroll wall defining a casing suction port, a second scroll wall opposed to the first scroll wall and holding the motor, and a peripheral wall connecting the first scroll wall and the second scroll wall, wherein the scroll casing houses the centrifugal fan such that the fan inlet port is adjacent to the casing suction port and defines a blowing passage space between the discharging ports and the peripheral wall and into which air discharged from the centrifugal fan flows, and at least one of the first scroll wall and the second scroll wall protrudes in the axial direction at a position corresponding to the blowing passage space so that the blowing passage space and a space provided in the protruded portion define a scroll air passage; and a directing member disposed at a position that a primary flow discharging from the centrifugal fan and a secondary flow that is created in the scroll air passage merge with each other so that one of the primary air flow and the secondary air flow is directed to be in parallel with the other; wherein the protruded portion has a substantially rectangular-shaped cross-section.

19. A centrifugal blower comprising:

a centrifugal fan including a boss portion, a plurality of blades arranged on a periphery of the boss portion in parallel to an axial direction, and a shroud connecting to ends of the blades, wherein the shroud defines a fan inlet port through which air is sucked in the centrifugal fan and the blades define discharging ports through which air is discharged in a radially outward direction;

a motor connected to the boss portion for driving the centrifugal fan;

a scroll casing including a first scroll wall defining a casing suction port, a second scroll wall opposed to the first scroll wall and holding the motor, and a peripheral wall connecting the first scroll wall and the second scroll wall, wherein the scroll casing houses the centrifugal fan such that the fan inlet port is adjacent to the casing suction port and defines a blowing passage space extending from the discharging ports to the peripheral wall and into which air discharged from the centrifugal fan flows, and at least one of the first scroll wall and the second scroll wall protrudes in the axial direction away from the discharging ports at a position corresponding to the blowing passage space so that an enlarged passage space is provided, the blowing passage space and the enlarged passage space combining to define a scroll air passage; and a directing member disposed at a position such that a primary air flow discharging into the blowing passage space from the centrifugal fan and a secondary air flow that is created in the enlarged passage space by the primary air flow combine with each other so that the primary air flow and the secondary air flow are in the same direction.

* * * * *